United States Patent [19]

Patel

[11] 4,230,749

[45] Oct. 28, 1980

[54] FLAME SPRAY POWDER MIX

[75] Inventor: Mahesh S. Patel, Albertson, N.Y.

[73] Assignee: Eutectic Corporation, Flushing, N.Y.

[21] Appl. No.: 66,875

[22] Filed: Aug. 15, 1979

Related U.S. Application Data

[60] Division of Ser. No. 967,919, Dec. 11, 1978, which is a continuation-in-part of Ser. No. 915,938, Jun. 15, 1978.

[51] Int. Cl.[3] ..... B05D 1/10

[52] U.S. Cl. ..... 427/423; 428/937

[58] Field of Search ..... 427/423; 75/252, 255, 75/0.5 R; 428/937

[56] References Cited

U.S. PATENT DOCUMENTS

| | | | |
|---|---|---|---|
| 3,313,633 | 4/1967 | Longo | 75/170 |
| 3,322,515 | 5/1967 | Dittrich et al. | 428/651 |
| 3,841,901 | 10/1974 | Novinski et al. | 428/467 |
| 4,031,278 | 6/1977 | Patel | 427/423 |
| 4,039,318 | 8/1977 | Patel | 75/0.5 R |
| 4,118,527 | 10/1978 | Patel | 428/697 |

*Primary Examiner*—Shrive P. Beck

*Attorney, Agent, or Firm*—Hopgood, Calimafde, Kalil, Blaustein and Lieberman

[57] ABSTRACT

A flame spray powder mix is provided for producing metal coatings on metal substrates, such as ferrous metal substrates, e.g., steel, cast iron, among other metal substrates, the powder mix comprising agglomerates of silicon and at least one metal disilicide, e.g., titanium disilicide, homogeneously mixed or blended with a coating metal powder, such as nickel powder.

7 Claims, 6 Drawing Figures

X 160

X 160

X 160

FLAME SPRAY POWDER MIX

This is a division of copending application Ser. No. 967,919, filed Dec. 11, 1978 which in turn is a continuation-in-part of U.S. Application Ser. No. 915,938, filed June 15, 1978.

This invention relates to a flame spray powder mix or blend and, in particular, to a flame spray powder mix or blend constituted of agglomerates of silicon and at least one metal silicide mixed with a coating metal powder, the mix being characterized when flame sprayed onto a metal substrate of providing an adherent bond coat exhibiting improved bond strength, said bond coat being capable of adhering to a subsequently applied overlay coating of substantial thickness.

STATE OF THE ART

It is known to coat metal substrates with a flame spray material to protect said metal substrates, such as a ferrous metal substrate, including steel and the like, and impart thereto improved properties, such as resistance to corrosion, and/or oxidation, and/or wear and the like. The metal sprayed may be in the form of a wire or a powder, powder spraying being a preferred method.

In order to provide a metal substrate with an adherent coating, it is the practice to clean the substrate and shot blast it with steel grit or thread the surface thereof on a lathe, if the shape is cylindrical, before depositing the metal coating thereon.

In U.S. Pat. No. 3,322,515, a method is disclosed for providing an adherent coating onto a metal substrate by first cleaning the substrate and flame spraying a metal bond coat therein using a flame spray powder in which elemental nickel and aluminum are combined together to form a composite particle. This type of powder, which is referred to in the trade as bond coat powder, provides a basis layer by means of which a sprayed overlayer of other metals and alloys of substantial thickness is adherently bonded to the metal substrate. With this technique, fairly thick overlayers can be produced.

The patent also states that ceramic deposits can be produced by mixing a ceramic with the nickel-aluminum composite powder, for example, 60% by weight of ceramic. Examples of ceramics are $Al_2O_3$ and carbides and silicides of Cr, Mo, W, and other refractory metals.

It is known that heated aluminum powder reacts exothermically with air to release a large amount of heat. It is believed that this mechanism is responsible in large part for the production of an adherent bond using nickel-aluminum powder in which fine aluminum powder is resin-bonded to a nickel core particle. The bond coat generally ranges in thickness from about 0.004 to 0.01 inch, as thicker coatings do not have satisfactory properties. It is also known to produce coatings of self-fluxing alloys, such as self-fluxing nickel-base alloys, in which aluminum powder is simply mixed with the nickel-base powder and sprayed to produce a dense hard coating, reference being made to U.S. Pat. No. 4,031,278.

The bond coat produced from nickel-aluminum composite powder has not been adequate as a final coat due to its poor machinability. Moreover, it is difficult to obtain thick coatings of good quality as generally the thicker the sprayed coating, the more powdery is the deposit. Such deposit is not conducive for providing a smooth surface finish by grinding or turning in a lathe;

and thus, this method has not been useful as a one-step coating technique.

One proposal for overcoming the foregoing problem and of providing a one-step bond coating is disclosed in U.S. Pat. No. 3,841,901. In this patent, it is proposed to add metallic molybdenum to the nickel-aluminum composite powder system or similar system (e.g., copper-aluminum, iron-aluminum, or even the nickel-copper-aluminum system), the amount of aluminum ranging from about 2% to 18% and molybdenum from about 0.5 to 16% by weight. The patent states that the addition of molybdenum as a constituent of the composite particle enables the production of a one-step nickel-aluminum-molybdenum coating of thickness, e.g., 0.03 to 0.05 inch, capable of providing a machined surface of good quality.

However, one of the disadvantages of using molybdenum is that, during flame spraying, molybdenum tends to produce smoke, especially in the upper range of composition.

In U.S. Pat. No. 4,039,318, a metaliferous flame spray material is disclosed, formed of a plurality of ingredients physically combined together in the form of an agglomerate, the plurality of ingredients in the agglomerate comprising by weight of about 3% to 15% aluminum, about 2 to 15% refractory metal silicide and the balance of the agglomerate essentially a metal selected from the group consisting of nickel-base, cobalt-base, iron-base and copper-base metals. A preferred combination is at least one refractory metal disilicide, e.g., $TiSi_2$, agglomerated with aluminum and nickel powder.

The foregoing combination of ingredients provides coatings, e.g., one-step coatings, having improved bond strength and improved machinability.

A common ingredient of the several types of prior art agglomerated powders referred to hereinabove is aluminum. While the presence of aluminum is believed to be beneficial for improving bond strength, it has been noted that the bond coat produced tends to have a dispersion of oxide therein which hardens the coating. In the case of a nickel bond coat, the coating is generally characterized by a fine dispersion of oxides. It is believed that, because the aluminum and nickel are intimately combined in the agglomerate, the violent oxidation of aluminum during flame spraying causes a rushing in of air during spraying which oxidizes the aluminum and produces a coating with dispersed oxides therein.

The presence of fine oxides in the coating tends adversely to affect the ductility of the bond coat. A ductile bond coat is desirable in that it has a greater resistance to fretting or spalling. Moreover, an applied overcoat to the bond coat will tend to resist spalling better where the underlying bond coat is more ductile and thus capable of withstanding thermal stresses better. The ductility of the bond coat is generally indicated by its hardness. Thus, the softer the coating, the greater is the tendency for it to be more ductile.

In application Ser. No. 915,938, the disclosure of which is incorporated herein by reference and of which this application is a continuation-in-part, a flame spray powder mix or blend is disclosed formed of agglomerates of metal silicide mixed with a coating metal powder with the average size of the agglomerates and the coating metal powder ranging from about 30 to 140 microns. The agglomerates comprise fine particles of a metal silicide of averge size less than 20 microns bound together in a matrix of a fugitive binder, the composition of the powder mix consisting essentially of about 2% to 15% by weight of the silicide, with substantially the balance the coating metal powder. A particular powder mix is one containing 5% by weight of $TiSi_2$ in agglomerate form mixed with 95% by weight of nickel powder. In a preferred embodiment, a mix may comprise agglomerates of metal silicide and agglomerates of silicon mixed with nickel to provide a mix containing, for example, 5% metal silicide, 5% silicon, and 90% nickel.

Coatings produced from the foregoing composition provide relatively clean microstructures low in oxide content and characterized by good bond strength. The application states that it may be desirable to agglomerate silicon powder directly with metal silicide. Additional work has indicated that consistently good bonding results are obtained with the latter embodiment, that is, with agglomerates comprised of metal disilicide and silicon bonded together within each of the agglomerates.

It would thus be desirable to provide an improved coating system capable of producing an adherent layer of substantial thickness on a metal substrate which is ductile and which has improved bond strength, which is low in dispersed oxides, and which can be machined to provide a good quality surface.

OBJECTS OF THE INVENTION

It is thus an object of the invention to provide a method for producing an adherent coating on a metal substrate having improved bond strength and which is capable of being machined to provide a good quality surface.

Another object is to provide a flame spray powder mix comprising agglomerates of silicon and at least one metal disilicide bonded together with the agglomerates mixed with a coating metal making up substantially the balance of the mixture.

A further object is to provide a flame spray powder capable of producing a bond coat of substantial thickness on metal substrates, e.g., ferrous metal substrates, in a one-step spray application and which is capable of being machined to a high finish.

Another object is to provide an improved flame spray method.

These and other objects will more clearly appear from the following disclosure and the accompanying drawings, wherein.

SUMMARY OF THE INVENTION

Figure 1:
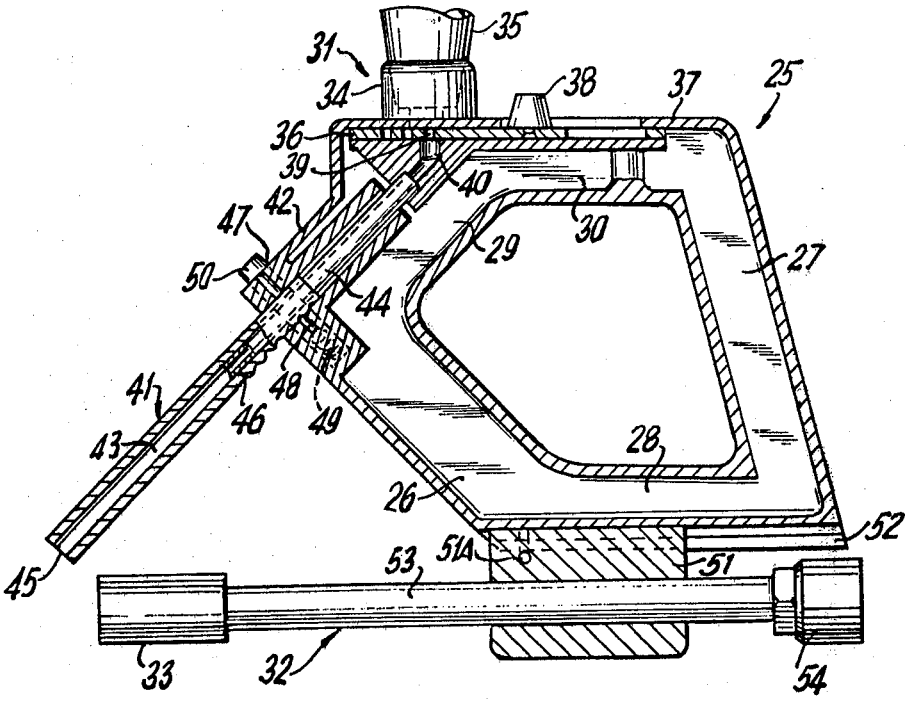
FIG. 1 is an illustration of one type of a flame spray torch which may be employed to spray the powder mix of the invention.

One embodiment of the invention is directed to a flame spray powder mix or blend formed of agglomerates of silicon powder and metal disilicide powder combined together and mixed with a coating metal powder, the average size of said metal disilicide-silicon agglomerates and said coating metal powder falling in approximately the same size range, for example, from about 30 to 140 microns. The amount of silicon combined with the metal disilicide is at least sufficient to provide a eutectic phase of lower melting point upon fusion, the amount of metal disilicide ranging from about 2% to 15% by weight.

The term "average size" means that the average size of all the agglomerates will be such as to range from about 30 to 140 microns. For example, it will be appreciated that some of the agglomerates may have sizes below 30 microns so long as the overall average of the agglomerates is 30 microns and above. Similarly, some of the agglomerates could have sizes above 140 microns so long as the overall average of the agglomerates is 140 microns or less.

What has been said for the agglomerates applies equally for the average size of the coating metal powder. The terms "powder mix" or "powder mixture" employed herein are meant to cover simple mixtures or blends of the metal disilicide-silicon agglomerates and the coating metal powder, the agglomerates being discernible from the particles of coating metal under the microscope. Where the powder mixture is a mixture of the agglomerates and particles of nickel, the nickel powder can be easily separated by a magnet from the agglomerates.

The composition of the powder mix with respect to the metal disilicide-silicon content may vary by weight from about 2% by 15% metal disilicide, about 2% to 15% silicon, with substantially the balance the coating metal powder. Preferably, the metal disilicide may range from about 2% to 10% and the silicon from about 2% to 10% by weight.

The agglomerates comprise fine particles of the metal disilicide and silicon bound together in a matrix of a fugitive binder. A fugitive binder is a thermally decomposable or vaporizable ingredient which serves as an adhesive in binding the particles together, such as a resin or an alkali metal silicate, which binder will release the ingredients while passing through the flame.

The particle size of the ingredients bound up in the agglomerate should be less than the particle size of the coating metal powder. That is to say, the average particle size of the metal disilicide and silicon should be less than 20 microns, preferably less than 15 microns, and generally range from about 1 to 10 microns.

Thus, if the metal disilicide and the silicon powder have an average particle size of about 5 microns, the disilicide-silicon agglomerate will have an average particle size ranging from about 30 to 140 microns similar to the coating metal powder.

Metal disilicides are preferred, such as disilicides of Ti, Zr, Hf, V, Nb, Ta, Cr, Mo, W, Re, Mn, and Co. The coating metal mixed with the metal disilicide-silicon agglomerate may be at least one metal from the group consisting of Ni, Co, Fe, Cu, nickel-base, cobalt-base, iron-base, and copper-base alloys.

The metal disilicide-silicon binary agglomerate is unique in that it provides a binary system upon fusion particularly advantageous for metal spraying. For example, the $MSi_2$-Si portion of the M-Si binary diagram is at the silicon-rich end of the diagram. In addition, the $MSi_2$-Si binary is characterized by a eutectic, the melting point of which is less than the melting points of $MSi_2$ and Si. By having excess silicon mixed and agglomerated with $MSi_2$, a self-fluxing deposit is promoted during flame spraying when the agglomerate is mixed with the coating metal, such as nickel powder, the $MSi_2$-Si eutectic serving as a solvent for nickel and similar coating metals when melted or fused.

The amount of silicon agglomerated with $MSi_2$ may be controlled to provide slightly hypo-eutectic or hyper-eutectic compositions, since the hypo- as well as the hyper-eutectic composition will melt at relative low temperatures, taking into account oxidation of silicon to form a flux during deposition of the desired coating.

Figure 5:
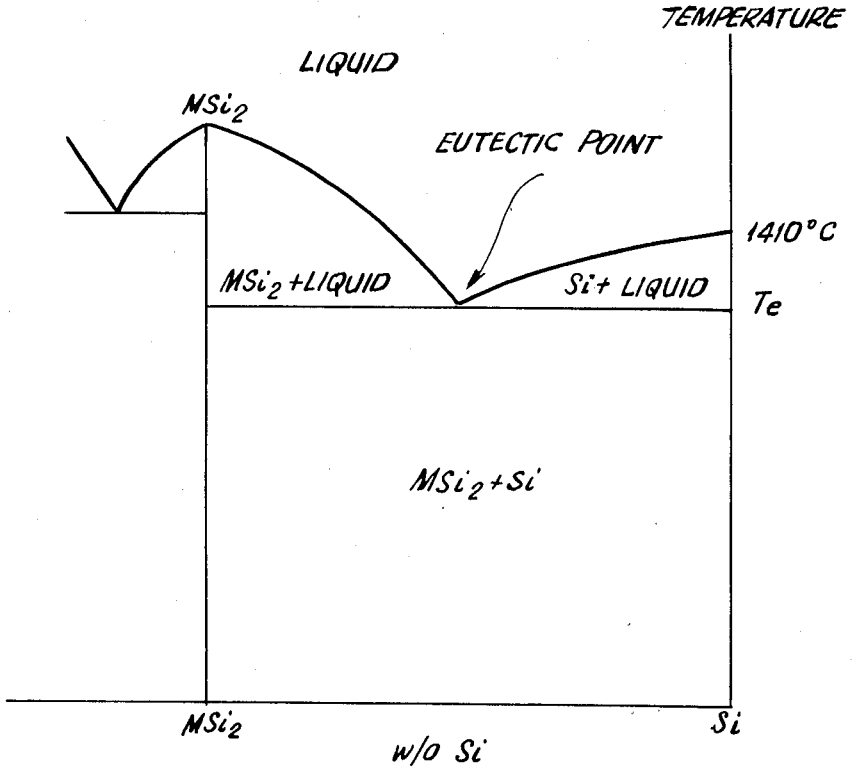
FIG. 5 is a general representation of the silicon-rich end of a metal disilicide-silicon binary diagram.

The general relationship between the $MSi_2$-Si portion of the M-Si phase diagram is shown in FIG. 5, with the eutectic point indicated therebetween. As will be noted, just above the eutectic melting point, a liquidus phase is shown at each side of the eutectic point (hypo- and hyper-eutectic) having the same solidification temperature as evidenced by horizontal line $T_e$.

Figure 6:
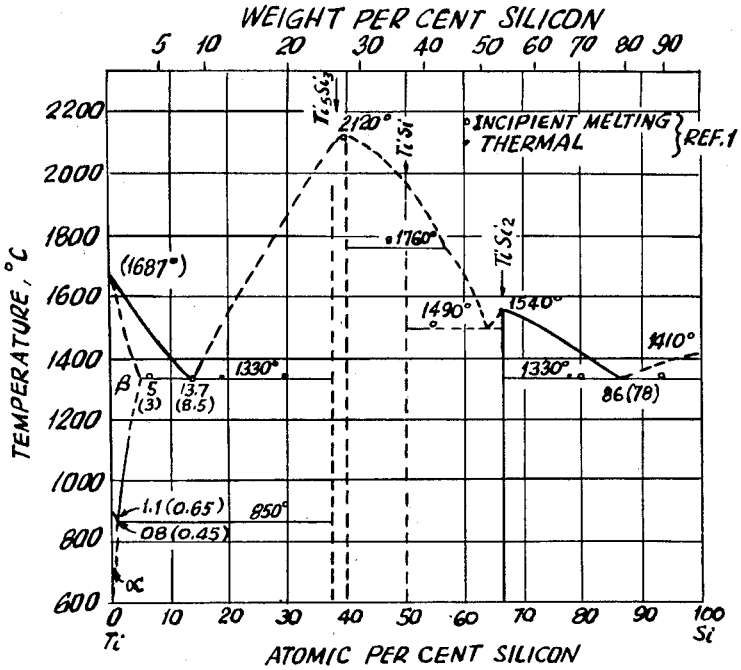
FIG. 6 depicts the silicon-rich end of the $TiSi_2$-Si binary.

The $TiSi_2$-Si binary system is one of the preferred embodiments for carrying out the invention, and this system is shown in FIG. 6, the melting point of $TiSi_2$ being 1540° C. and that of Si being 1420° C., the eutectic having a melting point of about 1330° C.

The following table sets forth a variety of $MSi_2$-Si systems having the unique relationship referred to hereinabove, that is, the eutectic solidification phenomenon particularly advantageous for flame spraying.

| System | Melting Point (°C.) Metal Silicide | Eutectic |
|---|---|---|
| $TiSi_2$—Si* | 1540 | 1330 |
| $ZrSi_2$—Si | 1584 | 1353 |
| $HfSi_2$—Si | 1543 | 1330 |
| $CrSi_2$—Si | 1490 | 1305 |
| $TaSi_2$—Si | 2200 | 1385 |
| $CoSi_2$—Si | 1326 | 1259 |
| $WSi_2$—Si | 2165 | 1400 |
| $MoSi_2$—Si | 2030 | 1410 |
| $NbSi_2$—Si | 1930 | 1305 |
| $VSi_2$—Si | 1680 | 1375 |
| $ReSi_2$—Si | 1980 | 1127 |

*The melting point of silicon is 1410 + 10° C.

Generally speaking, the melting or fusing of the metal disilicide will take place at temperatures somewhat lower than the actual melting point of the compound, so long as there is sufficient silicon present to bring the $MSi_2$-Si mixture near to the eutectic composition.

The powder mixture of the invention differs from the composite agglomerate of the prior art in that the metal disilicide is not combined with the coating metal in the agglomerate but is simply a mixture of the disilicide-silicon agglomerate with the coating metal.

Tests have shown that a system comprised of $TiSi_2$-Si-Ni in the form of agglomerates of 4% $TiSi_2$ and 6% Si mixed with 90% nickel when sprayed onto a steel substrate provided a surprisingly high bond strength superior to those obtainable with a nickel-aluminum agglomerate in which both the nickel and aluminum particles are agglomerated together. In addition, a cleaner bond coat is obtained with the powder composition of the invention.

An advantage of using metal disilicide-silicon agglomerates without aluminum in the agglomerate is that a narrow spray cone is obtained which provides better control of the flame spray reaction and greater heat concentration with the narrow cone where it is needed in the area being sprayed. The presence of aluminum tends to give a broader cone (an "overspray" cone configuration) in which the heat is not fully utilized where it is needed.

The metal disilicide system appears to work on a controlled oxidation-reduction principle in contrast to when aluminum is present. With aluminum, a vigorous oxidation reaction occurs. It is believed that the vigorous oxidation reaction of the aluminum results in a deposited coating having dispersed oxides therein.

On the other hand, when nickel is the coating metal mixed with the metal disilicide-silicon composite, e.g., $TiSi_2$-Si, the nickel deposited is very clean and generally exhibits a very low hardness of about 15 to 20 $R_B$ in contrast to the powder mix using aluminum combined with the nickel as an agglomerate in which the nickel deposited has dispersed oxides and has a hardness of about 60 to 70 $R_B$. Dispersed oxides are also produced from a spray powder in which titanium disilicide, aluminum and nickel are agglomerated together.

The flame spray powder mix provided by the invention enables the production of a single bond coat capable of being machined to a good finish. The bond coat also enables the build-up of a top coat thereon of a desired coating composition which adheres strongly to the bond coat. The powder mix may be sprayed using various types of metal spray torches well known in the art, particularly oxyacetylene torches. However, plasma spray torches may also be employed. Thus, the term "flame spray" used herein is meant to cover the foregoing types of torches in which the powder mix is injected into the flame, be it an oxyacetylene flame or a plasma flame, and the heated powder then applied to the metal substrate.

A preferred torch is that disclosed in U.S. Pat. No. 3,620,454 which is adapted for gravity feed of the powder externally to the flame issuing from a nozzle, the torch being depicted in FIG. 1.

DETAILS OF THE INVENTION

The powder mix of the invention enables the production of a one-step coating of substantial thickness ranging up to about 0.25 inch, for example, about 0.01 to 0.125 inch. Good bonding strengths are obtained. The bond coat which tends to be soft and ductile serves as an excellent base for the application of a top coat, such as a top coat of a nickel-base selffluxing alloy, or Ni-Cr-Fe iron alloy, or other alloy coatings of substantial thickness ranging up to 0.25 inch.

In producing the $MSi_2$-Si agglomerate, the finely divided disilicide powder is mixed in the proper amount with silicon powder and with a fugitive bonding agent, such as a resin, or other adhesive, e.g., alkali metal silicate. One example of a fugitive bonding agent is methyl methacrylate dissolved in methyl ethyl ketone. The amount of resin employed corresponds on a dry basis with respect to the $MSi_2$-Si content of about 2% to 3% by weight following evaporation of the solvent. Broadly speaking, the amount of binder on the dry basis may range from about 1% to 5% of the total combined weight of the ingredients being agglomerated.

Examples of resins which may be employed are the acrylates, e.g., methyl methacrylate, polyvinyl chloride, polyurethane, polyvinyl alcohol, and the like. The resins are employed as solutions, that is, dissolved in a compatible volatile organic solvent, such as alcohols, methyl ethyl ketone (MEK), xylol, and the like, and the solution in predetermined amounts mixed with the powdered ingredients and solvent evaporated to leave behind bonded agglomerates which are sized by passing the agglomerates through a screen of 100 mesh and preferably through 140 mesh. Examples of alkali metal silicates are sodium silicate and potassium silicate which are soluble in water. The mixing and agglomeration may be carried out in a Hobart mixer manufactured by the Hobart Manufacturing Company of Troy, Ohio.

As stated hereinbefore, while various flame spray torches may be employed for producing the coating on a metal substrate, a preferred torch is that shown in FIG. 1.

The flame spray torch 25 shown may be adapted for gravity feed of flame spray powder directly to the flame issuing from the nozzle as shown, or the powder feed may be automated by injection with a carrier gas under pressure (e.g, such as argon) from a powder feed unit.

The torch has a housing in the shape of a five-sided polygon with one leg of the polygon arranged as a handle portion 27, another leg as a base portion 28, a further leg as a feed portion 29, and another leg 30 of the polygon as the top portion of the torch. The housing 26 has coupled to it a powder feed assembly 31 and a flame assembly 32 to which is coupled nozzle 33.

The top leg portion 30 is provided with a fitting 34 adapted to receive a receptacle 35 (shown fragmentarily) for holding the flame spray powder, a metering device being employed to control powder feed comprising a feed actuator plate 36 slidably mounted in a slot 37 located in the housing top portion 30 below fitting 34. Feed plate 36 is provided with a knob 38 which protrudes upwardly above the housing and permits the sliding of feed plate 36 reciprocally toward and away from housing feed portion 29.

The agglomerates and powder mix flow by gravity unhindered through circular orifices which may range in size from 0.075 to 0.120 inch for different powders, the flow being maintained substantially constant over a mesh size range of minus 100 to plus 325 mesh.

In achieving the desired flow rate, feed plate 36 is selectively aligned with powder flow orifice 39 to control variably the flow rate of the powder from receptacle 35 through flow orifice 39 through conduit 40 and through variable spray control assembly 41. Assembly 41 has a housing 42 which holds a powder feed tube 43 and having a central core hollow cylinder 44 slidably and telescopically fitted within feed tube 43 and communicating directly with powder flow conduit 40 to deliver powder directly by gravity to feed tube 43, the powder then flowing through discharge end 45. A portion of the outer surface of feed tube 43 is provided with indexing means or grooves 46 which through latching assembly 47 enables the setting of powder feed tube 43 in order to locate discharge end 45 at the correct distance from the flame end of nozzle 33. The latching assembly comprises a holding pin 48 that is normally urged toward one of the indexing grooves 46 by spring 49, the holding pin 48 being actuated by rod 50 in making the setting. Thus, by depressing rod 50, the pin is moved out of contact with one of the indexing grooves and tube 43 set according to the desired position.

The flame assembly 32 is supported by sliding element 51 which can be lockingly moved along a track 52 located at the bottom leg 28 of housing 26, a locking pin 51A being provided as shown. Gas flow tube 53 is fixedly held by sliding element 51 and may be factory set, one end of the tube having a connector 54 for attaching to a source of oxygen and acetylene.

The powder flows down tube 43 and is discharged at 45 into the flame issuing from nozzle 43. The powder is sprayed on a metal substrate, e.g., a steel shaft, at about six to eight inches from the workpiece.

In one embodiment of the invention, $TiSi_2$ and silicon are agglomerated together at 60% silicon and 40% $TiSi_2$ using a phenolic resin (e.g., phenolformaldehyde) in a solvent (ethyl alcohol) as the bonding agent to provide, following drying at 350° F. (177° C.), a retained amount of about 3% resin by weight in said agglomerate. Predetermined amounts of the agglomerates of average size ranging from about 30 to 140 microns are then mixed with nickel powder of average size ranging from about 30 to 140 microns, the composition of the total mix based on the metal content being about 4% $TiSi_2$, 6% Si, and 90% of Ni by weight. The powder is then flame sprayed onto a clean substrate of a 1020 steel using the oxyacetylene gravity feed torch shown in FIG. 1 to produce a strongly adherent bond coat.

As illustrative of additional embodiments of the invention, the following examples are given:

EXAMPLE 1

A water solution of sodium silicate was employed as a binder to agglomerate $TiSi_2$ and Si. The $TiSi_2$ particles had an average size of about 5 microns and the Si powder had a particle size ranging from about 5 to 10 microns. The powder mixture was agglomerated in a Hobart mixer after adding sufficient sodium silicate solution (containing about 40% by weight of sodium silicate) to wet the powder to ultimately provide an agglomerate containing 2% by weight sodium silicate on the dry basis. The mixing was carried out at a temperature of about 150° C. until the water evaporated to provide an agglomerate having an average size ranging from about 30 to 75 microns, the amount of sodium silicate in the agglomerate as stated above being about 2% by weight on the dry basis.

Predetermined amounts of the foregoing agglomerate corresponding by weight to 4% $TiSi_2$ and 6% Si were mixed with nickel powder of average size ranging from minus 200 mesh to plus 325 mesh (about 45 to 75 microns).

The aforementioned powder mixture was flame sprayed using an oxyacetylene torch of the type illustrated in FIG. 1, the metal substrate being a 1020 steel. The average bond strength was obtained in accordance with ASTM designation C633–69. The determination is made by using a set of two cylindrical blocks one inch in diameter and one inch long. An end face of each block of the set is ground smooth and one face coated with the aforementioned bond coat compositions by flame spraying to a thickness of about 0.005 to 0.01 inch. A high strength overcoat is applied to the bond coat, the high strength overcoat being a nickel-base alloy known by the trademark Inconel (7% Fe-15% Cr-balance Ni) which has a bond strength of over 10,000 psi, that is, much higher than the bond coat being tested. The thickness of the high strength overcoat is about 0.015 inch; and after depositing it, the overall coating, which has a thickness ranging up to about 0.025 inch, is then finished ground to about 0.015 inch. A layer of epoxy resin is applied to the overcoat layer, the epoxy layer having a bond strength of over 10,000 psi.

The other block of the set is similarly end ground and a layer of high strength epoxy resin applied to it. The two blocks of the set, one with the metal coating and the epoxy layer is clamped to the other with the epoxy faces of the blocks in abutting contact and the clamped blocks subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined blocks using a tensile testing machine for recording the breaking force. The bonding strength is then determined by dividing the force obtained at failure by the area of the one inch circular face of the blocks.

The bond strengths of the following flame spray powders were compared using the foregoing testing procedure:

(1) $TiSi_2$ and Si agglomerated and mixed with Ni.

(A) ($TiSi_2$+Al+Ni) agglomerated.

(B) (Ni+Al) agglomerated.

Item (1) is a composition coming within the invention.

Item (A) is a composition derived from U.S. Pat. No. 4,039,318 in which $TiSi_2$, Al and Ni powders are all agglomerated together.

In Item (B), Ni and Al powders are agglomerated together.

The composition of each of the spray powders and the ultimate bonding strength are as follows:

| Item No. | Composition | Bond Strength |
|---|---|---|
| 1 | 4% $TiSi_2$ - 6% Si - 90% Ni | 4,917 psi |
| A | 4% $TiSi_2$ - 6% Al - 90% Ni | 4,621 psi |
| B | 5.5% Al - 94.5% Ni | 3,631 psi |

As will be noted, Item 1, which is an average of 20 determinations, is at least comparable to Items A and B, except that the coatings produced with the composition of Item 1 are cleaner and more ductile than the coatings of Item A or Item B.

Figure 2:
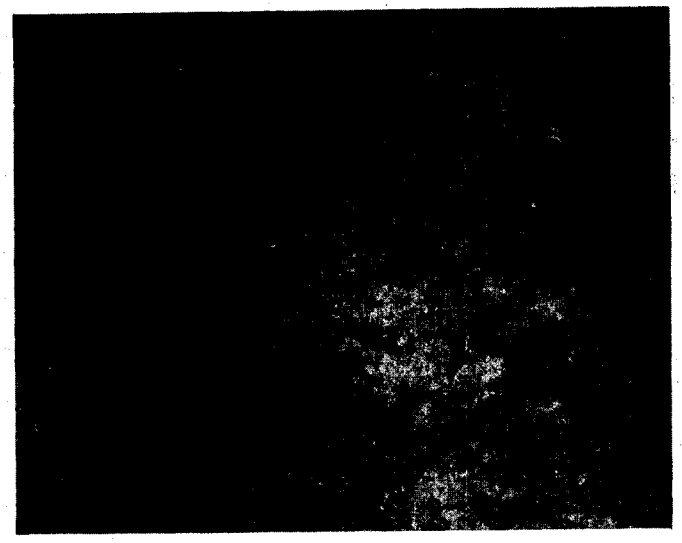
FIG. 2 is a representation of a photomicrograph taken at 160 times magnification of a cross section of a sprayed coating produced in accordance with the invention.
Figure 3:
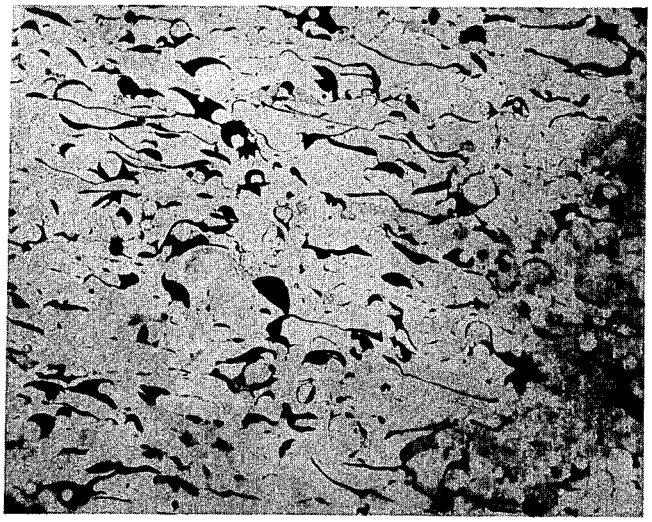
FIG. 3 is a representation of a photomicrograph taken at 160 times magnification produced from a powder agglomerate containing titanium disilicide, aluminum and nickel.
Figure 4:
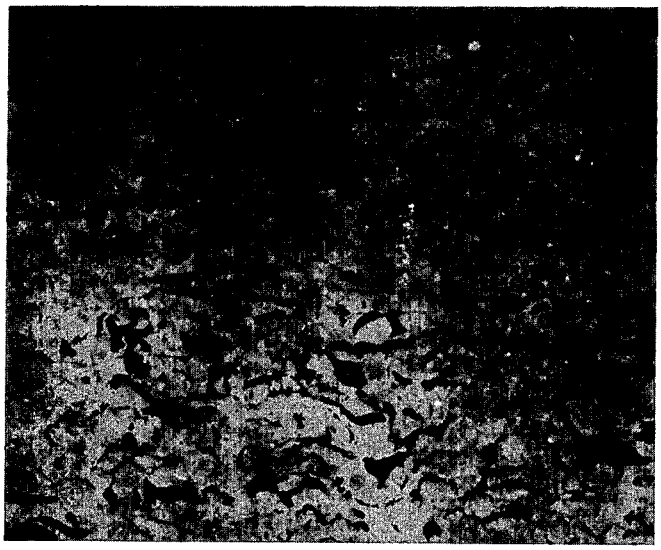
FIG. 4 is a representation of a photomicrograph taken at 160 times magnification of a cross section of a sprayed coating based on a powder agglomerate containing nickel and aluminum.

As illustrative of the soundness of the coating produced by Item 1 as compared to A and B, reference is made to photomicrographs of FIGS. 2 to 4 taken at 160 times magnification.

As will be noted, FIG. 2 (the $TiSi_2$-Si-Ni system of the invention) is much cleaner and denser than the systems shown in FIG. 3 and FIG. 4. The photomicrographs of FIGS. 3 and 4 show a dispersion of oxides as dark areas throughout the cross section of the coating in addition to some voids.

As illustrative of the various flame spray compositions provided by the invention, the following examples are given:

| Item No. | Composition |
|---|---|
| 2 | 3.5% $CrSi_2$ - 6.5% Si - 90% Ni |
| 3 | 8% $CrSi_2$ - 5% Si - 87% Ni |
| 4 | 10% $VSi_2$ - 10% Si - 80% Ni |
| 5 | 8% $MoSi_2$ - 2% Si - 90% Fe |
| 6 | 5% $WSi_2$ - 5% Si - 90% Ni |
| 7 | 9% $NbSi_2$ - 6% Si - 85% Ni |
| 8 | 10% $TiSi_2$ - 5% Si - 85% (Ni-base alloy) (Alloy contains 3% Si, 2% B, 1% Cr, 0.2% Mo and balance nickel.) |
| 9 | 3% $ZrSi_2$ - 3% Si - 94% Cu |
| 10 | 10% $MnSi_2$ - 5% Si - 85% Ni |
| 11 | 7% $HfSi_2$ - 8% Si - 85% (Co-base alloy) (Alloy contains 3% Ni, 28% Cr, 1% Si, 2% B, 1% C, 4.5% W, 3% Mo and balance Co.) |
| 12 | 7% $CoSi_2$ - 8% Si - 85% Ni |
| 13 | 8% $TiSi_2$ - 7% Si - 85% (Cu-base alloy) (Alloy contains 20–25% Ni, 3–4% Si, 0.25–0.5% B, 0.5–1% Mn and balance Cu.) |
| 14 | 5% $ZrSi_2$ - 10% Si - 85% Ni |
| 15 | 8% $TiSi_2$ - 4% Si - 88% (304 Stainless Steel) (Steel contains 0.03 max C, 2 max Mn, 1 max Si, 18–20 Cr, 8–12 Ni and balance Fe.) |
| 16 | 12% $CrSi_2$ - 3% Si - 85% (Inconel 690) (Alloy contains .03 max C, 0.75 max Mn, 0.5 max Si, 30 Cr, 9.5% Fe and Balance Ni.) |
| 17 | 4% $TiSi_2$ - 6% Si - 90% aluminum bronze (Alloy contains 10% Al, 2% Fe and balance Cu.) |
| 18 | 8% $WSi_2$ - 7% Si - 85% Monel (Alloy contains 1.25% Fe, 31.5% Cu, 1% Mn, 0.25% Si, 0.15% C, and balance Ni.) |

As stated hereinbefore, the disilicide powder-silicon is separately agglomerated and then mixed with the coating metal.

As stated hereinbefore, the agglomerates can be mixed with such coating metals as nickel-base, cobalt-base, iron-base, copper-base alloys (e.g., aluminum bronze), as well as nickel, cobalt, iron and copper per se.

Examples of alloys which may be employed as coating metals are given as follows:

NICKEL-BASE MATRIX ALLOY

| Constituent | Range in Percent By Weight | Example |
|---|---|---|
| Silicon | 1.5–5.0 | 3.0 |
| Boron | 1.5–5.0 | 2.0 |
| Chromium | 0–20 | 1.0 |
| Molybdenum | 0–7 | 0.2 |
| Nickel | (1) | (1) |

(1) Essentially the balance.

The foregoing alloy may be substituted in nickel content by cobalt or iron. Also, alloys of this type can consist as a matrix containing refractory carbide particles (e.g., WC) in a fine particle size to effect a further improvement in abrasion resistance. The following matrix alloy may be employed.

COBALT-BASE MATRIX ALLOY

| Constituent | Range in Percent By Weight | Example |
|---|---|---|
| Nickel | 1.–5.0 | 3.0 |
| Chromium | 20.0–32.0 | 28.0 |
| Silicon | 0.5–3.0 | 1.0 |
| Boron | 1.0–3.0 | 2.0 |
| Carbon | 0.8–2.0 | 1.0 |
| Tungsten | 3.5–7.5 | 4.5 |
| Molybdenum | 0.0–5.0 | 3.0 |
| Cobalt | (1) | 57.5 |

(1) Essentially the balance.

Again, nickel or iron may be substituted in the above formulation for a like amount of cobalt.

A particularly preferred copper-base matrix alloy which has been found useful has the following constituents in percentages by weight as indicated:

| | COPPER-BASE ALLOY | |
|---|---|---|
| Constituent | Broad Range | Intermediate Range |
| Nickel | 15.0-40.0 | 20-25 |
| Silicon | 1.0-5.0 | 3.0-4.0 |
| Boron | 0.15-2.50 | 0.25-0.5 |
| Manganese | 0.20-2.00 | 0.5-1.0 |
| Copper | (1) | (1) |

(1) Essentially the balance.

As an example of a matrix alloy within the foregoing ranges, there may be mentioned:

| Constituents | Percent By Weight |
|---|---|
| Nickel | 23.00 |
| Silicon | 3.45 |
| Boron | 0.47 |
| Manganese | 0.75 |
| Copper | (1) |

(1) Essentially the balance.

The foregoing alloys are preferably employed as atomized powders. A particular nickel-base alloy is one containing about 3% Si, 2% B, 1% Cr, 0.2% Mo and the balance essentially nickel. It is preferred that the average size of the coating metal range from minus 200 mesh to plus 325 mesh.

As-sprayed coatings of substantial thickness may be produced in accordance with the invention, e.g., coating thicknesses of up to about 0.25 inch, e.g., about 0.01 to 0.125 inch. Generally speaking, the final coating will contain less than 15% by weight of metal disilicide (e.g., disilicides of Ti, Zr, Hf, V, Nb, Ta, Cr, Mo and W) and generally less than about 10% by weight. The isolated gray areas shown in FIG. 2 are disilicides, although some silicon per se is also observable.

While the sprayed metal coating of the invention has shown particular applicability to ferrous metal substrates, the sprayed metal coating is also compatible with metal substrates comprising nickel, cobalt, aluminum-base alloys and copper substrates, among other compatible metal substrates.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A method of producing an adherent bond coat on a metal substrate which comprises, flame spraying onto said metal substrate a powder mixture formed of agglomerates of at least one metal disilicide selected from the group consisting of Ti, Zr, Hf, V, Nb, Ta, Cr, Mo, W, Re, Mn, and Co combined together with silicon and mixed with a coating metal powder, said metal disilicide ($MSi_2$) and silicon when thermally fused together providing a eutectic phase of the binary $MSi_2$-Si, the average size of said agglomerates and said coating metal powder ranging from about 30 to 140 microns, said agglomerates being made up of fine particles of said metal disilicide and silicon of average size less than about 20 microns bound together in a matrix of a fugitive binder, the composition of said powder mixture ranging from about 2% to 15% by weight of said metal disilicide and sufficient silicon in the range of about 2% to 15% by weight to provide a eutectic phase of said binary $MSi_2$-Si, with substantially the balance of said flame spray powder mixture being said coating metal powder, and continuing said spraying to form an inherent bond coat on said substrate characterized by improved bond strength.

2. The flame spray method of claim 1, wherein the coating metal is selected from the group consisting of Ni, Co, Fe, Cu, nickel-base, cobalt-base, iron-base, and copper-base alloys.

3. The flame spray method of claim 1, wherein the metal disilicide agglomerated with silicon is $TiSi_2$.

4. A method of producing an adherent bond coat on a metal substrate which comprises, flame spraying onto said metal substrate a powder mixture formed of agglomerates of $TiSi_2$ combined together with silicon and mixed with a coating metal powder, the average size of said agglomerates and said coating metal powder ranging from about 30 to 140 microns, said agglomerates being made up of fine particles of said $TiSi_2$ and silicon of average size less than about 20 microns bound together in a matrix of a fugitive binder, the composition of said powder mixture ranging from about 2% to 15% by weight of said $TiSi_2$ and 2% to 15% by weight of silicon, with substantially the balance said coating metal powder, and continuing said spraying to form an adherent bond coat on said substrate characterized by improved bond strength, said $TiSi_2$ and said silicon when fused together providing a eutectic phase of the binary $TiSi_2$-Si.

5. The method of claim 4, wherein the amount of $TiSi_2$ and silicon each ranges from about 2% to 10% by weight.

6. The flame spray method of claim 4, wherein the coating metal is selected from the group consisting of Ni, Co, Fe, Cu, nickel-base, cobalt-base, iron-base, and copper-base alloys.

7. The flame spray method of claim 4, wherein the coating metal powder is nickel.

* * * * *